US005582019A

United States Patent [19]

Hanna et al.

[11] Patent Number: 5,582,019

[45] Date of Patent: Dec. 10, 1996

[54] METHOD AND APPARATUS FOR RECOVERING AND PURGING REFRIGERANT

[75] Inventors: William T. Hanna, Gahanna; Joseph G. Murray, Worthington; Rodney L. Osborne, Hebron; John H. Faught, Grove City, all of Ohio

[73] Assignee: Emerson Electric Company, St. Louis, Mo.

[21] Appl. No.: 436,731

[22] Filed: May 8, 1995

[51] Int. Cl.[6] ..... F25B 47/00

[52] U.S. Cl. ..... 62/85; 62/195; 62/475; 62/292

[58] Field of Search ..... 62/475, 95, 85, 62/292, 77, 149

[56] References Cited

U.S. PATENT DOCUMENTS

| | | | |
|---|---|---|---|
| 3,145,544 | 8/1964 | Weller | 62/475 |
| 3,620,038 | 6/1970 | Muench | 62/195 |
| 4,316,364 | 2/1982 | Spauschus | 62/475 |
| 4,766,733 | 8/1988 | Scuderi | 62/77 |
| 4,809,515 | 3/1989 | Houwink | 62/149 |
| 4,981,020 | 1/1991 | Scuderi | 62/77 |
| 5,355,685 | 10/1994 | Stie et al. | 62/475 |
| 5,367,886 | 11/1994 | Manz et al. | 62/475 |

*Primary Examiner*—John M. Sollecito
*Attorney, Agent, or Firm*—Vickers, Daniels & Young

[57] ABSTRACT

Apparatus for recovering refrigerant from a refrigeration system having a high pressure liquid side and a low pressure vapor side comprises a storage receptacle for receiving recovered refrigerant, a liquid flow circuit for recovering liquid from the high pressure side of the system, a vapor flow circuit for recovering vapor from the low pressure side of the system, and a vapor feedback flow circuit from the receptacle to the inlet side of a vapor reducing section of the vapor flow circuit. The apparatus is operable in a liquid recovery mode and in a vapor recovery mode, and an arrangement for automatically purging non-compressible gases from liquid refrigerant is provided in the vapor flow circuit on the downstream side of the vapor reducing section thereof. During a liquid recovery operation, vapor is fed back from the storage receptacle to the inlet side of the vapor reducing section and non-condensable gas in the liquid refrigerant flowing therefrom is separated from the liquid prior to return of the liquid refrigerant to the storage receptacle. During a vapor recovery operation, the apparatus is operable to shift back to the liquid recovery mode in response to a high pressure in the storage receptacle, whereby vapor in the receptacle is fed back and reduced to a liquid from which non-condensable gas is removed prior to return of the liquid to the receptacle. Gas removed from the liquid refrigerant is accumulated and periodically exhausted to atmosphere.

75 Claims, 4 Drawing Sheets

METHOD AND APPARATUS FOR RECOVERING AND PURGING REFRIGERANT

BACKGROUND OF THE INVENTION

The present invention relates to the art of refrigerant recovery and, more particularly, to an improved method and apparatus for recovering refrigerant from a refrigerating system having a high pressure liquid side and a low pressure vapor side and purging gas from the refrigerant during the recovery thereof.

The present invention finds particular utility in conjunction with refrigerant recovering apparatus operable in a liquid recovery mode and in a vapor recovery mode and which, when operating in the vapor recovery mode, is responsive to an unacceptably high pressure and thus temperature in the refrigerant recovery receptacle to disconnect the source of vapor being recovered from vapor reducing components of the apparatus and to circulate vapor in the recovery receptacle to the vapor reducing components for reduction to a liquid which is returned to the recovery receptacle, thus to reduce the pressure and temperature therein to acceptable levels. At the same time, as will become apparent hereinafter, the invention is applicable to refrigerant recovery methods and apparatus other than those including an arrangement for cooling the recovery receptacle during the vapor recovery operation.

A refrigerant recovery unit of the foregoing character is available from Ridge Tool Company of Elyria, Ohio under the latter's product designation Model RS-200 which is a portable unit for recovering a variety of refrigerants from air conditioning and other refrigeration systems having a high pressure liquid side and a low pressure vapor side from which refrigerant must be withdrawn in a recovery operation. This unit includes a casing enclosing the refrigerant recovery components including a compressor and condenser, flow lines and valving, and electrical circuitry which controls operation of the unit. The refrigerant recovery components provide liquid and vapor flow circuits having inlet ends selectively connectable through flexible hoses to the high pressure liquid and low pressure vapor sides of a refrigeration system from which refrigerant is to be recovered. The flow circuits have outlet ends connected to the refrigerant storage tank through a flexible hose. The refrigerant recovery components further include a vapor feed back circuit connectable to the storage tank through a flexible hose and by which vapor in the storage receptacle is adapted to be fed back to and through the vapor reducing components for return to the storage receptacle as a liquid. The electrical control circuit provides for the unit to be selectively operated in the liquid recovery mode and in the vapor recovery mode.

In the liquid recovery mode, liquid refrigerant from the refrigeration system is drawn directly into the storage receptacle, bypassing the vapor reducing components, and vapor in the storage receptacle is fed back and reduced in the foregoing manner and returned to the receptacle as a liquid. In the vapor mode, the vapor feedback circuit is closed and vapor is drawn from the refrigeration system and is reduced and pumped to the storage receptacle as a liquid. During vapor recovery, the pressure and thus the temperature in the storage receptacle can become undesirably high and, the pressure in the storage receptacle is monitored and, in response to an undesirably high pressure indicating an undesirably high temperature, the unit shifts to the liquid recovery mode whereby the vapor input from the refrigeration system to the vapor reducing components is blocked and the vapor feedback circuit is opened. This results in feed back of vapor from the receptacle to the vapor reducing components as described above, thus to reduce the pressure in and cool the storage receptacle. When the pressure is reduced sufficiently, the unit shifts back to the vapor recovery mode, whereby the feedback circuit is again closed and the input of vapor from the refrigeration system is recommenced so as to continue the vapor recovery operation. While it would be possible to discontinue operation of the unit during vapor recovery in response to an undesirably high temperature in the storage receptacle and then recommence the recovery operation when the temperature subsides sufficiently, the vapor feedback arrangement advantageously provides for minimizing the vapor recovery time by automatically providing a cooling function in conjunction with operation of the unit.

In connection with operating a refrigerant recovery unit of the foregoing character, it is of course necessary to purge air from the flexible hoses and from the liquid and vapor flow circuits prior to starting a recovery operation. Such purging is done manually and is time consuming. In this respect, the flexible hoses for connecting the high and low pressure sides of the refrigeration system with the recovery unit and for connecting the refrigerant storage receptacle with the unit include in-line valves to minimize the escape of refrigerant during start-up and shut-down of the equipment, and the storage receptacle has shut-off valves for the liquid and vapor line connections thereto. Moreover, as is well known, a refrigerating system from which refrigerant is to be recovered has service valves associated with each of the high pressure liquid and low pressure vapor sides of the system. Thus, there are 8 valves which have to be opened and closed and several hose connections which have to be loosened and tightened in connection with purging air from the equipment prior to initiating the refrigerant recovery operation. Moreover, when the unit is operating in the liquid recovery mode, or is shifted to the latter mode during vapor recovery as described above in response to an undesirably high pressure in the storage receptacle, the liquid flowing back to the receptacle from the vapor reducing components flows through a capillary expander. Non-condensable gases in the liquid, primarily air, cannot easily pass through the capillary tube and, thus, back up and accumulate in the condenser. This reduces the cooling capacity of the feedback flow circuit and thus increases the time required to lower the pressure in the storage receptacle to the level at which the unit shifts back to the vapor recovery mode. This in turn increases the overall time required to complete the vapor recovery operation.

SUMMARY OF THE INVENTION

In accordance with the present invention, refrigerant recovery apparatus having liquid flow circuitry, vapor flow circuitry for reducing vapor to liquid, and a vapor feedback circuit for vapor in the refrigerant recovery storage receptacle to be reduced and returned to the receptacle as a liquid is provided with a gas purging arrangement. The purging arrangement is between the vapor reducing section of the vapor flow circuit and the refrigerant storage receptacle and is adapted to remove gas from liquid refrigerant flowing from the vapor reducing section to the receptacle. The vapor feedback circuit is open to the vapor reducing section at least during operation of the apparatus to recover liquid from the high pressure liquid side of a refrigeration system and, preferably, is adapted to be connected with the vapor reducing section in response to an unacceptably high pressure in the storage receptacle during a vapor recovery operation so as to achieve cooling and a reduction of pressure in the receptacle so as to optimize the time required to achieve completion of a vapor recovery operation. In any event, the gas purging arrangement eliminates the need to manually purge the apparatus prior to initiating a refrigerant recovery operation and, in the preferred arrangement, additionally serves to minimize the time required to achieve completion of a vapor recovery operation by avoiding the backup of non-condensable gas into the vapor reducing section of the vapor recovery circuit. The gas removed from the liquid refrigerant is accumulated and exhausted to atmosphere and, preferably, the operation of the gas purging arrangement in this respect is automatic through a purging control circuit which is activated when the apparatus is in the liquid recovery mode. If the apparatus is operable during vapor recovery to achieve vapor feedback from the storage receptacle for cooling and reducing the pressure in the receptacle as described above, the purge control circuit is activated during such feedback operation so as to enable the exhausting of purged gas to atmosphere.

Preferably, a gas purging arrangement according to the invention includes a chamber arrangement providing for non-condensable gas in the liquid refrigerant to gravitate upwardly therefrom into an accumulating or storage space from which the gas is exhausted to atmosphere. Preferably, the quantity of accumulated gas is monitored and, in response to the accumulation of a pre-determined quantity, the gas is released to atmosphere. Still further in accordance with a preferred arrangement, the exhausting of accumulated gas to atmosphere is periodic and is controlled in part by a timer in the purge control circuit which has a repeating time cycle including purge and non-purge modes, respectively enabling and disabling the exhaust of gas to atmosphere. Thus, if the timer is activated and a pre-determined quantity of gas has accumulated in the chamber arrangement, the accumulated gas will be exhausted during each purge portion of successive timer cycles. The removal of gas from the liquid refrigerant flowing from the vapor reducing section advantageously eliminates or minimizes the problem referred to hereinabove with regard to the backup of gas into the vapor reducing section of the vapor flow circuit during a vapor recovery operation.

It is accordingly an outstanding object of the present invention to provide refrigerant recovery apparatus operable in a liquid recovery mode and in a vapor recovery mode with an arrangement for purging gas from liquid refrigerant flowing to a refrigerant recovery storage receptacle from a vapor reducing section of the apparatus.

Another object is the provision of refrigerant recovery apparatus of the foregoing character wherein the gas purging arrangement eliminates the need to manually pre-purge the apparatus prior to initiating a refrigerant recovery operation.

A further object is the provision of refrigerant recovery apparatus of the foregoing character wherein the purging arrangement is operable in the liquid recovery mode and can be operated during the vapor recovery mode to minimize the vapor recovery time.

Yet another object is the provision of refrigerant recovery apparatus of the foregoing character wherein the purging arrangement is activated when the apparatus is in the liquid recovery mode and is actuated to exhaust gas to atmosphere upon the accumulation of a pre-determined quantity of gas.

Still a further object is the provision of refrigerant recovery apparatus of the foregoing character wherein the purging arrangement is adapted to be activated when the apparatus is operating in the vapor mode in response to the existence of an undesirable condition in the recovery receptacle.

Another object is the provision of refrigerant recovery apparatus of the foregoing character wherein the gas purging arrangement provides for the separation of gas from liquid refrigerant by gravitation of the gas into an accumulating chamber in which the quantity of accumulated gas is monitored and from which accumulated gas is periodically exhausted to atmosphere.

A further object is the provision of a method and apparatus for recovering refrigerant from a refrigeration system and for purging gas from the refrigerant being recovered and during the recovery operation, such that manual pre-purging of the recovery apparatus is not necessary and such that the overall recovery operation is more efficient and less time consuming than heretofore possible.

BRIEF DESCRIPTION OF THE DRAWING

The foregoing objects, and others, will in part be obvious and in part pointed out more fully hereinafter in conjunction with the written description of a preferred embodiment of the invention illustrated in the accompanying drawing in which.

DESCRIPTION OF A PREFERRED EMBODIMENT

Figure 1:
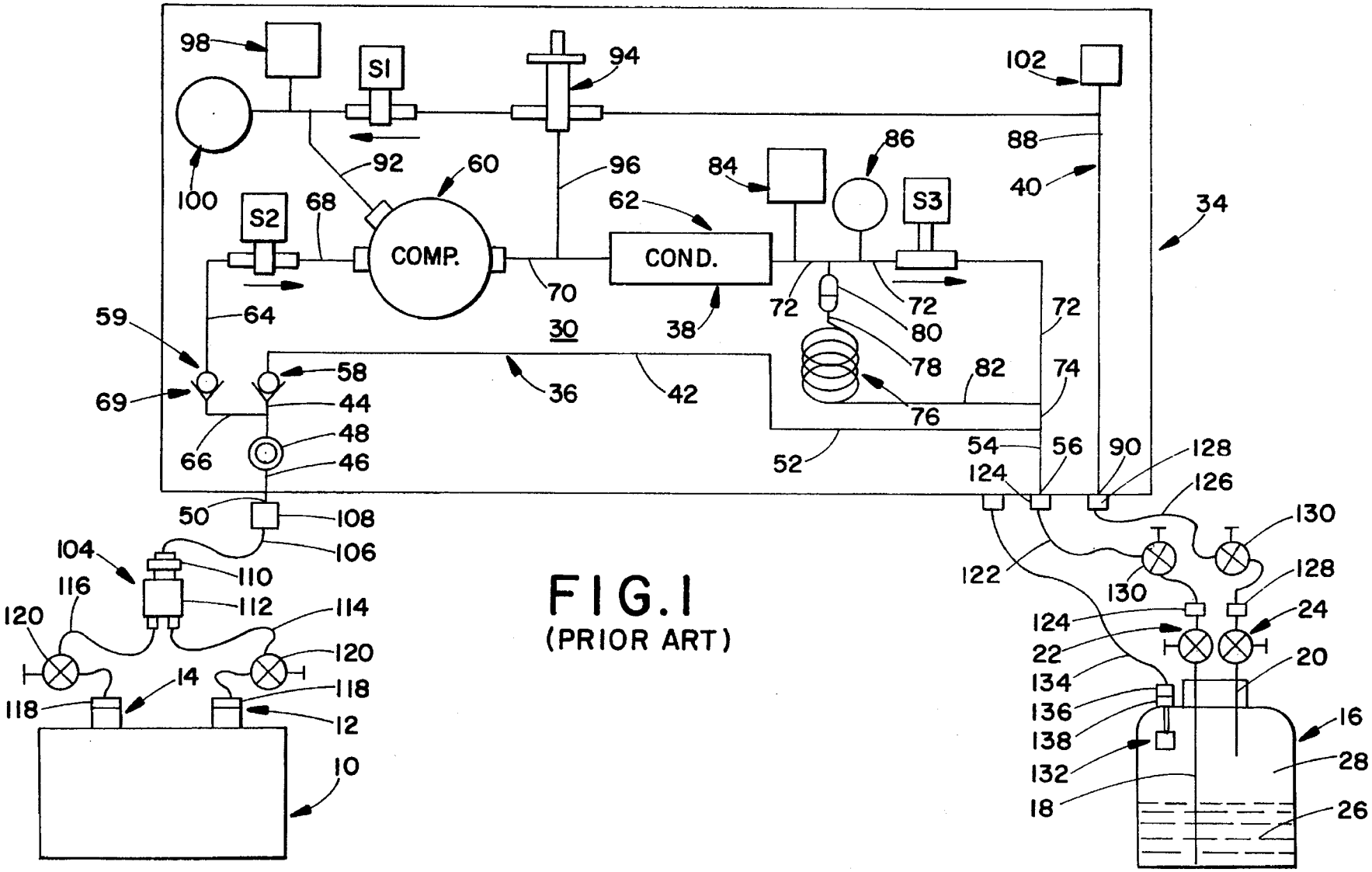
FIG. 1 (PRIOR ART)
FIG. 1 is a liquid flow diagram for a prior art refrigerant recovery system.
Figure 2:
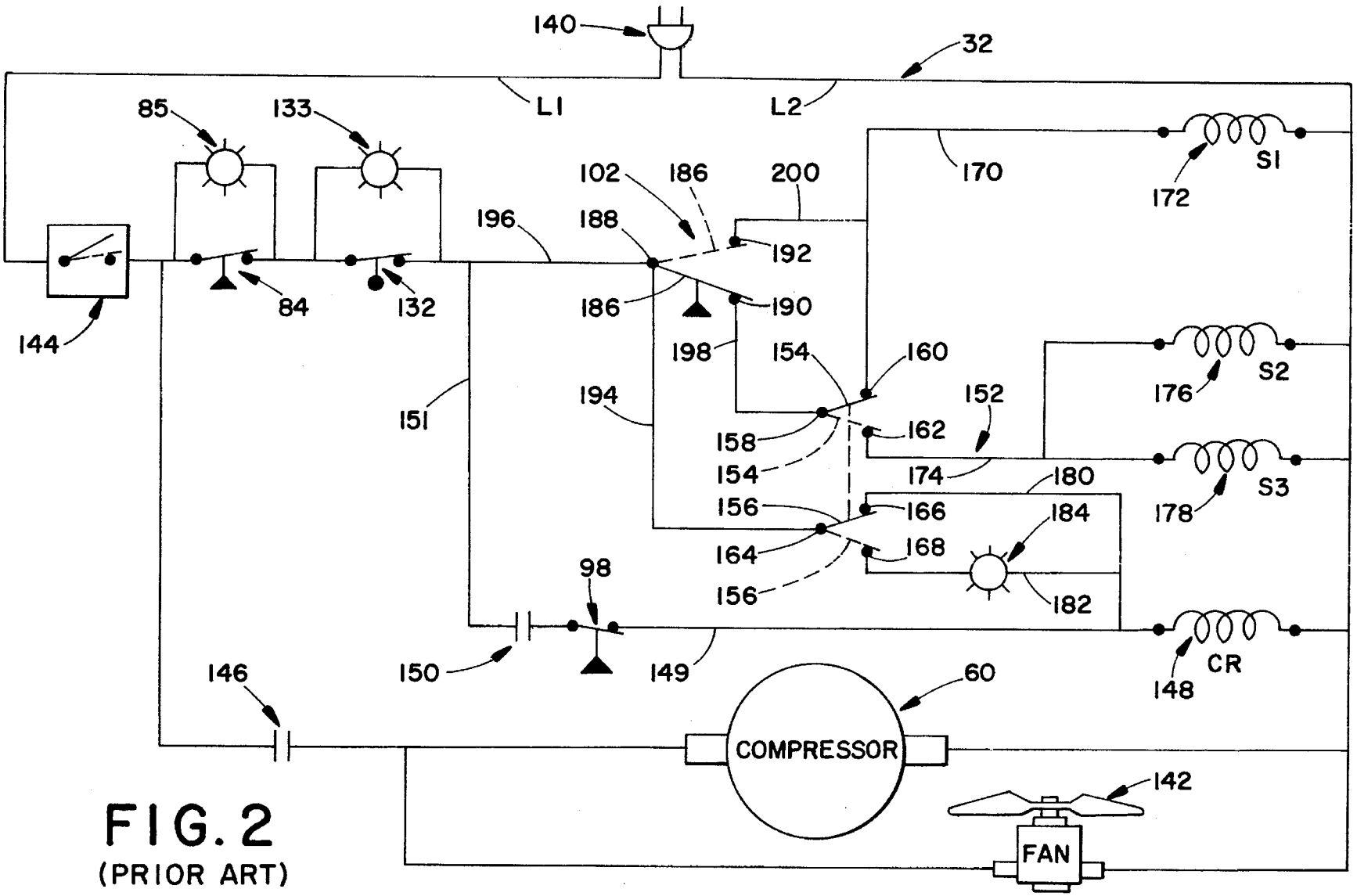
FIG. 2 (PRIOR ART)
FIG. 2 is a wiring diagram for the system illustrated in FIG. 1.

Referring now in greater detail to the drawings, wherein the showings are for the purpose of illustrating a preferred embodiment of the invention only and not for the purpose of limiting the same, FIGS. 1 and 2 schematically illustrate prior art apparatus for recovering refrigerant from an air conditioning or refrigeration system 10, hereinafter referred to collectively as a refrigeration system, and which system has a high pressure liquid side and a low pressure vapor side from which refrigerant is to be recovered and which sides are respectively assessable through service valves 12 and 14. The refrigerant recovery apparatus includes a recovered refrigerant storage receptacle 16 having a liquid refrigerant inlet line 18 and a vapor outlet line 20 opening thereunto through corresponding manually operated shut-off valves 22 and 24. As will be explained in greater detail hereinafter, line 18 provides a passageway for the flow of liquid refrigerant 26 into receptacle 16, and line 20 provides a passageway for vapor 28 above liquid 26 to flow out of the receptacle. The refrigerant recovery apparatus further includes liquid and vapor flow circuitry 30 as shown in FIG. 1 and an electrical circuit 32 therefor as shown in FIG. 2. The component parts of circuits 30 and 32 are housed in a casing 34 which, while not shown, provides for the component parts of the apparatus therein to be portable and carried to the location of refrigeration system 10 together with receptacle 16 which is separable from the component parts in casing 34.

Liquid and vapor circuitry 30 includes a liquid flow circuit 36, a vapor flow circuit 38, and a vapor feedback circuit 40. Liquid flow circuit 36 includes a flow line 42 having an inlet end 44 connected to a system inlet line 46 through a sight glass 48 which serves the purpose set forth hereinafter. Inlet line 46 has an outer end 50 adjacent the exterior of casing 34 for connecting the recovery apparatus to refrigeration system 10 as set forth more fully hereinafter. Flow line 42 has an outlet end 52 connected to a system outlet line 54 which has an outer end 56 adjacent the exterior of casing 34 for connecting outlet line 54 with storage tank 16 as set forth hereinafter. A check valve 58 is provided in flow line 42 adjacent inlet end 44 thereof for precluding the backflow of liquid refrigerant through inlet line 46.

Vapor flow circuit 38 includes a vapor reducing section comprising a compressor 60 and condenser 62 by which vapor flowing through the vapor flow circuit is reduced to a liquid for flow to the storage receptacle. The vapor flow circuit further includes a flow line 64 having an inlet end 66 connected to system inlet line 46 between sight glass 48 and check valve 58. Flow line 64 has an outlet end 68 connected to the inlet side of compressor 60 through a normally closed solenoid valve S2, and a check valve 69 is provided in line 64 adjacent inlet end 66 to preclude the backflow of vapor through inlet line 46. The outlet side of compressor 60 is connected to the inlet end of condenser 62 by a flow line 70, and the outlet side of condenser 62 is connected to a flow line 72 having an outlet end 74 connected to system outlet line 54. A normally closed solenoid valve S3 is provided in line 72 between the condenser and outlet end 74, and the vapor flow circuit further includes a capillary expander 76 having an inlet end 78 connected to flow line 72 between condenser 62 and valve S3 and through a strainer 80. The outlet end 82 of the capillary expander is connected to flow line 72 between valve S3 and outlet end 74 of the flow line. For the purpose set forth hereinafter, a high pressure switch 84 and a high pressure gage 86, the latter of which is visible exteriorly of casing 34, are connected to flow line 72 between condenser 62 and valve S3.

Vapor feedback flow circuit 40 includes a flow line 88 having an inlet end 90 disposed adjacent the exterior of casing 34 for connection to storage tank 16 as set forth hereinafter. Flow line 88 has an outlet end 92 connected to the inlet side of compressor 60, and a normally closed solenoid valve S1 and a diaphragm actuated compressor throttling valve 94 are provided in flow line 88 between the inlet and outlet ends thereof. A flow line 96 connects the diaphragm chamber of valve 94 with line 70 on the outlet side of compressor 60, whereby the compressor outlet pressure provides a pilot pressure for operating valve 94. For the purpose set forth hereinafter, a low pressure switch 98 and a low pressure gage 100, the latter of which is visible from the exterior of casing 34, are connected to flow line 88 between valve S1 and end 92 of the flow line and thus on the inlet side of the compressor, and a pressure responsive switch 102 is connected to flow line 88 between inlet end 90 thereof and valve 94.

The inlet ends of liquid flow circuit 36 and vapor flow circuit 38 are adapted to be connected to the high pressure liquid and the low pressure vapor sides of refrigeration system 10 by a flexible hose assembly 104 which includes a hose 106 having a coupling 108 for attaching the hose assembly to outer end 50 of inlet line 46. The hose assembly further includes a filter 110 to which hose 106 is connected and a flow divider 112 to which a pair of flexible hoses 114 and 116 are connected. Hoses 114 and 116 include corresponding couplings 118 by which the hoses are adapted to be connected respectfully to service valves 12 and 14 of the refrigeration system, and each of the hoses is provided with a manually operable in-line shut-off valve 120 to minimize the loss of refrigerant during attachment and detachment of the recovery apparatus with the refrigeration system. While hose assembly 104 provides a single connection to the inlet side of the apparatus and thus the inlet ends of the liquid and vapor flow circuits, it will be appreciated that the flow circuits could have separate inlet ends for connection to separate hoses for connection to the corresponding one of the high pressure liquid and low pressure vapor sides of the refrigeration system.

Outlet line 54 of the liquid and vapor flow circuits is adapted to be connected to liquid line 18 of storage receptacle 16 by means of a flexible hose 122 having couplings 124 at the opposite ends thereof for connection with outer end 56 of outlet line 54 and liquid valve 22 of receptacle 16. Flow line 88 of vapor feedback circuit 40 is adapted to be connected to vapor line 20 in receptacle 16 by means of a flexible hose 126 having couplings 128 at the opposite ends thereof for connection with outer end 90 of flow line 88 and vapor valve 24 of receptacle 16. Each of the hoses 122 and 126 is provided with a manually operable in-line shut-off valve 130 for the same purpose as valves 120 referred to hereinabove. Preferably, storage receptacle 16 is provided with a float switch 132 for the purpose set forth hereinafter, and the float switch is adapted to be connected to the electric control circuit for the apparatus through switch cable 134 which extends from housing 34 and has a plug 136 at the outer end thereof for connection with a plug receptacle 138 on storage receptacle 16.

Referring now to FIG. 2 which shows the electric control circuit for the refrigerant recovery apparatus, power lines L1 and L2 of the control circuit are adapted to be connected to a 115 volt AC power supply by means of a power cord extending from casing 34 and having a plug 140 at the outer end thereof. Compressor 60 and a cooling fan 142 in parallel therewith are connected across lines L1 and L2 through a manually operable on-off switch 144 and a normally open relay 146. Coil 148 for relay 146 is connected across lines L1 and L2 through line 149, normally closed low pressure switch 98, a second normally open relay 150, line 151, normally closed receptacle float switch 132, normally closed high pressure switch 84, and on-off switch 144. An indicator light 85 is connected in shunt across high pressure switch 84, and an indicator light 133 is connected in shunt across float switch 132, both for the purpose set forth hereinafter. The control circuit further includes a manually operable selector switch 152 by which the recovery apparatus is selectively operated in the liquid recovery mode and in the vapor recovery mode. More particularly in this respect, switch 152 is a double pole double throw switch having switch arms 154 and 156 which, in the solid line positions thereof shown in FIG. 2, provide for the apparatus to operate in the liquid recovery mode and in the broken line positions thereof provide for the apparatus to operate in the vapor recovery mode. Switch arm 154 has a base terminal 158 and contacts 160 and 162 between which the arm is displacable, and switch arm 156 has a base terminal 164 and contacts 166 and 168 between which the arm is displacable. Contact 160 is connected to line L2 through line 170 and coil 172 of solenoid valve S1, and contact 162 is connected to line L2 through line 174 and coils 176 and 178 of solenoid valves S2 and S3, respectfully, which are connected in parallel with one another between line 174 and line L2. Contact 166 of switch arm 156 is connected to line L2 through line 180 and relay coil 148, and contact 168 is connected to line L2 through line 182, line 180 and relay coil 148. Line 182 includes an indicator light 184 for indicating completion of a refrigerant recovery operation and functions in this respect as set forth more fully hereinafter.

Pressure responsive switch 102 associated with flow line 88 of vapor feedback circuit 40 is interposed between selector switch 152 and line L1. Switch 102 is a single pole double throw switch having a switch arm 186, a base terminal 188 and contacts 190 and 192 between which arm 186 is displacable. Switch arm 186 is normally in the solid line position thereof shown in FIG. 2 and is displaced to the broken line position thereof in the manner and for the purpose set forth more fully hereinafter. Base terminal 188 is connected to base terminal 164 of switch arm 156 of selector switch 152 by line 194 and is connected to line L1 by line 96, float switch 132, high pressure switch 84 and on-off switch 144. Contact 190 of switch 102 is connected to base terminal 158 of switch arm 154 of selector switch 152 by line 198, and contact 192 of switch 102 is connected to line 170 by line 200.

Assuming that the apparatus has been connected to refrigeration system 10 and refrigerant recovery storage receptacle 16 as described herein, and further assuming that the apparatus has been purged of air and residual refrigerant therein by the appropriate manual manipulation of the various valves and hose fittings so as to purge high pressure liquid hose 114, low pressure vapor hose 116, liquid flow circuit 36, liquid valve hose 122, vapor flow circuit 38 and vapor valve hose 126, the apparatus is prepared for a recovery operation which is performed as follows. It is preferred to first perform a liquid recovery operation and, accordingly, selector switch 152 is positioned to operate the recovery apparatus in the liquid recovery mode, whereby the several switches in the apparatus control circuit are in the solid line positions thereof shown in FIG. 2. Service valve 12 for the high pressure liquid side of refrigeration system 10 is then opened together with valve 120 in high pressure hose 114, liquid and vapor valves 22 and 24 of storage receptacle 16 and valves 130 in liquid and vapor hoses 122 and 126. The apparatus is then turned on by closing on-off switch 144 which connects relay 148 across lines L1 and L2 through normally closed switches 84 and 132, lines 96 and 94, switch arm 156 of selector switch 152 and line 180. Relay coil 148 is thus energized to close relays 146 and 150 whereby compressor 60 begins running. Relay 150 connects relay coil 148 across lines L1 and L2 independent of selector switch 152 for the purpose set forth hereinafter. Further, the closure of on-off switch 144 connects coil 172 of solenoid valve S1 across lines L1 and L2 through switches 84 and 132, line 196, switch arm 186 of switch 102, line 198, switch arm 154 of selector switch 152 and line 170, whereby coil 172 is energized to open solenoid valve S1 and thus connect vapor 28 in receptacle 16 in flow communication with the inlet side of compressor 60 through vapor feedback circuit 40. In the liquid recovery mode, switch arm 154 of selector switch 152 disengages contact 162, whereby the circuit to coils 176 and 178 of solenoid valves S2 and S3 is open and valves S2 and S3 are closed.

As will be appreciated from FIG. 1, the foregoing relationships provide for liquid refrigerant from refrigeration system 10 to flow through line 42 of liquid flow circuit 36 to storage receptacle 16 through liquid line 18 therein. During such flow, vapor 28 in receptacle 16 is fed back to the inlet side of compressor 60 through feedback circuit 40 and open valve S1, and this vapor is pumped through compressor 60 and condenser 62 and is reduced thereby to a liquid. Since valve S3 is closed, the liquid flows through capillary expander 76 and is cooled thereby and returned through outlet line 54 to receptacle 16 as a liquid. During such feedback flow, diaphragm valve 94 throttles the flow of vapor to the inlet side of compressor 60 based on a pilot pressure in line 70 at the outlet side of the compressor. High pressure gage 86 on the downstream side of condenser 62 provides a visual reading of the compressor discharge pressure during operation of the apparatus in the liquid recovery mode, and high pressure switch 84 operates to shut-down the apparatus in response to a pre-determined undesirably high pressure which opens the switch. Operation of the apparatus in the foregoing manner continues until all of the liquid refrigerant has been withdrawn from refrigeration system 10, and the latter can be determined by observing the absence of liquid in sight glass 48.

When all of the liquid has been withdrawn, low pressure vapor side service valve 14 of refrigeration system 10 is opened as is valve 120 in low pressure vapor hose 116, and selector switch 152 is displaced to the vapor recovery mode position thereof, whereby switch arms 154 and 156 move to the broken line positions thereof shown in FIG. 2. Thus, as will be appreciated from FIG. 2, switch arm 154 disengages contact 160 to open the circuit to coil 172 of solenoid valve S1, whereby the latter valve closes, and the switch arm engages contact 162 to connect solenoid coils 176 and 178 across lines L1 and L2, whereby the coils are energized to open solenoid valves S2 and S3. At the same time, switch arm 156 disengages contact 166 and engages contact 168. While this opens the circuit to line 180, relay coil 148 remains energized across normally closed low pressure switch 98 and previously closed relay 150, whereby relay 146 remains closed and compressor 60 continues to run. The engagement of switch arm 156 with contact 168 connects indicator light 184 in shunt across low pressure switch 98 and relay 150, whereby the indicator light is unlit at the beginning of the vapor recovery operation. During the vapor recovery operation, vapor from the low pressure side of refrigeration system 10 flows through vapor flow circuit 38 and thus through solenoid valve S2 to compressor 60 and condenser 62. The vapor is thus reduced to a liquid which flows through open solenoid valve S3 and thence through line 72 to outlet line 54 and to storage tank 16 through liquid line 18 thereof. During operation in the vapor recovery mode in the foregoing manner, solenoid valve S1 is closed, whereby there is no feedback of vapor 28 from receptacle 16 through feedback circuit 40.

The liquid flowing from condenser 62 follows the path of least resistance through solenoid valve S3 and thus bypasses capillary expander 76 and the cooling effect achieved with respect to flow of the liquid therethrough to receptacle 16 during liquid recovery. Accordingly, during vapor recovery operation, the temperature in receptacle 16 and thus the pressure therein can become undesirably high. While the recovery apparatus could be shut down under such circumstances until the temperature drops to an acceptable level, it is preferred to monitor the pressure in receptacle 16, and thus the temperature, and to shift the apparatus back to the liquid recovery mode. This shift reopens vapor feedback circuit 40 for the flow of vapor from receptacle 16 to the inlet side of compressor 60 and thence to condenser 62, whereby the vapor is reduced to a liquid and returned to receptacle 16 through capillary expander 76. Such shifting of the apparatus is achieved by pressure responsive switch 102 in vapor feedback circuit 40. More particularly in this respect, and as will be appreciated from FIG. 2, when the pressure in receptacle 16 and thus the temperature therein reaches a predetermined undesirably high level switch arm 186 of pressure responsive switch 102 is displaced from the solid line position thereof to the broken line position, thus to disengage contact 190 and to engage contact 192. In the vapor recovery phase, switch arm 154 of selector switch 152 is in the broken line position thereof shown in FIG. 2, whereby displacement of switch arm 186 of switch 102 to its broken line position opens the circuit through line 198 to coils 176 and 178 of solenoid valves S2 and S3, whereby the latter close. At the same time, engagement of switch arm 186 with contact 192 of switch 102 closes the circuit through lines 200 and 170 to coil 172 of solenoid valve S1, whereby the latter opens. Thus, vapor in receptacle 16 is fed back through flow circuit 40 as described above until such time as the pressure in receptacle 16 drops to an acceptable level. When the latter occurs the apparatus shifts back to the vapor recovery mode by the return of switch arm 186 to the solid line position thereof in FIG. 2. This shift causes solenoid valve S1 to close and solenoid valves S2 and S3 to reopen, whereby the apparatus functions to reduce vapor from the low pressure vapor side of refrigeration system 10 as described above. The foregoing shifting of the apparatus from the vapor recovery mode to the liquid recovery mode and back to the vapor recovery mode with selector switch 152 in the vapor recovery mode position thereof continues until such time as all of the vapor in the low pressure side of the refrigeration system as been recovered. Such automatic cycling of the apparatus advantageously minimizes the overall recovery time. When the recovery of vapor has been completed, the apparatus automatically shuts down. In this respect, normally closed low pressure switch 98 opens in response to a predetermined vacuum pressure when all of the vapor has been recovered to open the circuit to relay coil 148 thus to open the circuit to compressor 60 by opening relay 146. Low pressure gage 100 provides a visual indication of the pressure during the vapor recovery procedure. The opening of low pressure switch 98 energizes indicator light 184 to provide a visual indication that recovery is complete. High pressure switch 84 is responsive to a higher pressure than that of switch 102 and is operable in response to an undesirably high compressor discharge pressure or receptacle pressure during operation of the apparatus to open the circuit to relay coil 148, thus to shut down the compressor. The opening of high pressure switch 84 energizes indicator light 85 for visually indicating the existence of a high pressure condition. If the level of liquid 26 in receptacle 16 reaches that of float switch 132, the latter likewise opens the circuit to relay coil 148 to shut down compressor 60, and the opening of switch 132 energizes indicator light 133 to visually indicate that the receptacle is full.

Figure 3:
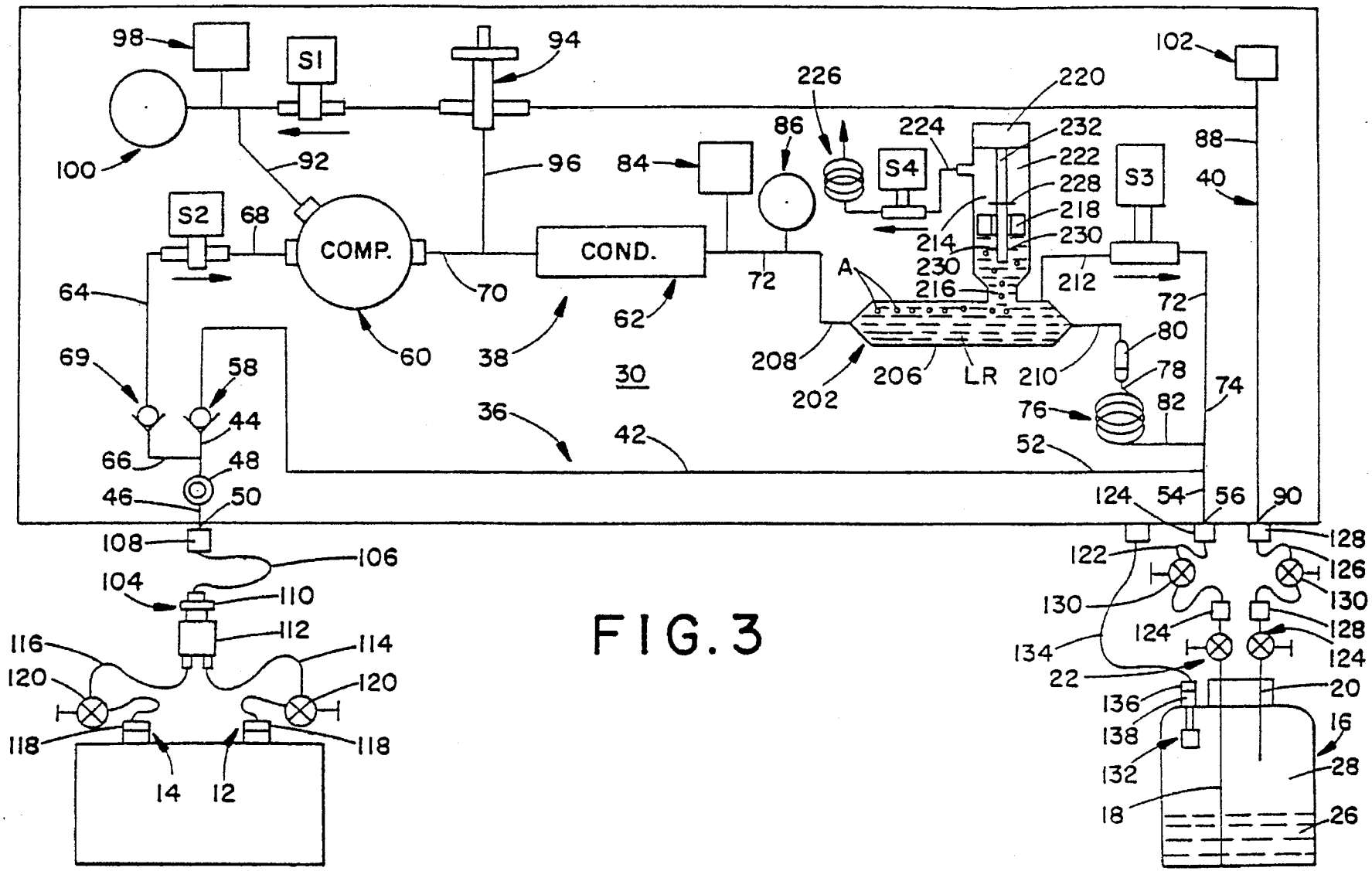
FIG. 3 is a liquid flow diagram similar to FIG. 1 and including a gas purging arrangement in accordance with the present invention.
Figure 4:
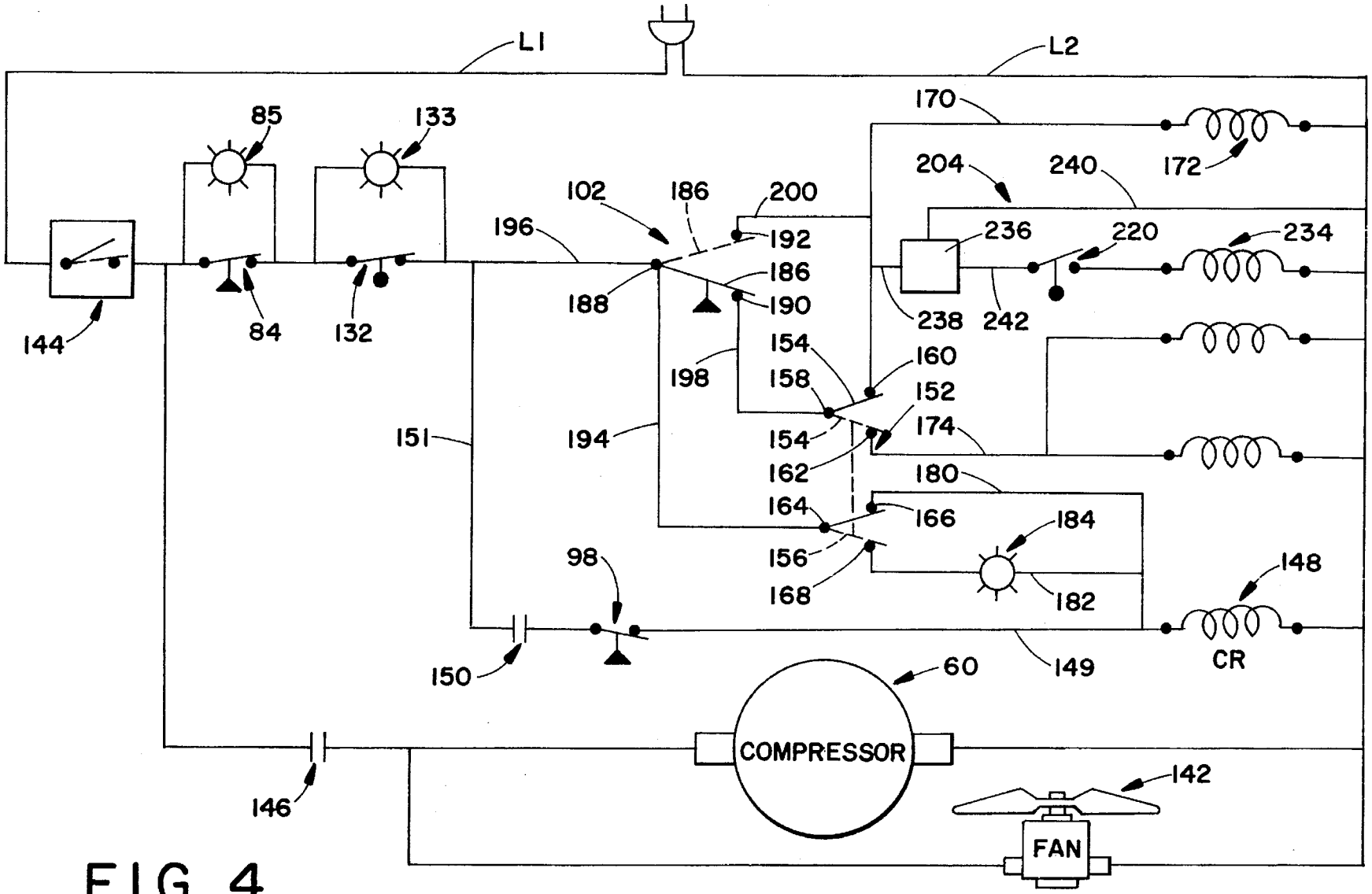
FIG. 4 is a wiring diagram similar to FIG. 2 and including a control circuit for the purging arrangement.

When operating the recovery apparatus in the liquid recovery mode, and when shifting to the liquid recovery mode in response to a high pressure in the storage receptacle, air in the liquid on the downstream side of condenser 62 cannot easily pass through capillary expander 76 and, thus, backs up in the condenser. This results in a low cooling capacity and a high operating pressure which can actuate high pressure switch 84 causing the apparatus to cycle on and off. Such cycling precludes continuous operation of the apparatus and increases the operating time required to complete a recovery operation. This disadvantage is overcome in accordance with the present invention by incorporating a gas purging arrangement 202 in the apparatus on the downstream side of condenser 62, as shown in FIG. 3, and incorporating a purging control circuit 204 in the apparatus control circuit as shown in FIG. 4 of the drawing. Otherwise, the component parts of the apparatus and control circuit are structurally and functionally the same as that described hereinabove in conjunction with FIGS. 1 and 2 of the drawing and, accordingly, are designated in FIGS. 3 and 4 by the same numbers and letters.

Referring first to FIG. 3, purging arrangement 202 is interposed in flow line 72 between the downstream side of condenser 62, solenoid valve S3 and capillary expander 76. In the embodiment illustrated, purging arrangement 202 includes a horizontal gas separating chamber 206 having an inlet end 208 defined by line 72 and having an outlet end defined by line 210 connected to strainer 80 of capillary expander 76. The top of chamber 206 adjacent outlet end 210 thereof is connected by line 212 in flow communication with solenoid valve S3 and line 72. Purging arrangement 202 further includes a vertically disposed float and gas accumulating chamber 214 having a necked in lower end 216 opening into the top of chamber 206 at a location closer to outlet end 210 than to inlet end 208. Chamber 214 houses a float 218 which is operable as set forth more fully hereinafter to control a float switch 220 which has a normally open or deactivated position and which, when closed or activated, enables opening of a normally closed solenoid valve S4 to exhaust accumulated gas to atmosphere. More particularly in this respect, chamber 214 has an upper end 222 in which gas removed from the liquid refrigerant accumulates as set forth hereinafter. Upper end 222 is provided with an outlet line 224 normally closed by solenoid valve S4 and for the purpose set forth hereinafter, the exhaust of accumulated gas through valve S4 to atmosphere is preferably through a capillary tube 226. Float 218 is reciprocable in chamber 214 between upper and lower stops 228 and 230, respectively, and in the embodiment illustrated the lower stops are defined by a pair of electrical contacts adapted to be bridged by float 218, or conductive material attached thereto, to achieve closing of switch 220 when float 218 is in its lower most position. Stops 228 and contacts 230 are mounted on a tubular float guide 232 extending downwardly in chamber 214 from switch 220 and which float guide encloses the electrical switch wires, not shown, for switch contacts 230.

In the embodiment illustrated, compressor 62 is a ⅓ horse power reciprocating compressor operating between design pressures of from about 215 PSI to about 395 PSI, and separating chamber 206 is constructed from copper tubing and is about 7 inches long and has an outer diameter of about 0.75 inch. Inlet end 208, outlet end 210 and line 212 are defined by copper tubing brazed to chamber 206 and having an inner diameter of about 0.2 inch. Capillary expander 76 is a copper tube having an uncoiled length of about 4 feet and an inner diameter of about 0.036 inch. Float and gas storage chamber 214 has a height of about 8 inches and is defined by copper tubing having an inner diameter of about 1 inch above lower end 216 which has a diameter of about 0.5 inch and is brazed to chamber 206. Capillary tube 226 has an uncoiled length of about 10 feet and an inner diameter of about 0.028 inch and serves to control the time and flow rate of the venting of purged gas to atmosphere.

Referring now to FIG. 4, purge control circuit 204 includes float switch 220, a solenoid coil 234 for solenoid valve S4, and a timer 236 which has a timing cycle including purge and non-purge portions for the purpose set forth hereinafter. Timer 236, float switch 220 and solenoid coil 234 are connected in series with one another and in parallel with coil 172 of solenoid valve S1 between lines 170 and L2 Accordingly, as will be appreciated from the foregoing description of apparatus control circuit 32, control circuit 204 is adapted to be activated when selector switch 152 is positioned for the apparatus to operate in the liquid recovery mode. Likewise, when the selector switch is positioned for the apparatus to operate in the vapor recovery mode control circuit 204 is adapted to be activated in conjunction with shifting back to the liquid recovery mode in response to a high pressure in storage receptacle 16. Timer 236 is connected between lines 170 and L2 by lines 238 and 240 which provide for the timing cycle of timer 36 to be initiated upon activation of the purge control circuit in the liquid recovery mode and in response to the shifting to the latter mode during a vapor recovery operation. During the purge portion of the time cycle of timer 236, the timer completes a circuit between lines 238 and line 242 to float switch 220, and during the non-purge portion of the time cycle, the latter circuit is open. Accordingly, as will become more apparent hereinafter, the purge and non-purge portions of the timer cycle respectively enable and disable the exhausting of accumulated gas to atmosphere from upper end 222 of chamber 214.

It is believed that the following description of the operation of the purging arrangement will be understood from the foregoing description of the purging apparatus and purging control circuit together with the foregoing description of the recovery apparatus and apparatus control circuit illustrated in FIGS. 1 and 2. When selector switch 152 is positioned for the apparatus to operate in the liquid recovery mode, solenoid valve S1 is open, solenoid valves S2 and S3 are closed, and liquid refrigerant from the high pressure side of refrigeration system 10 flows through liquid flow circuit 36 to refrigerant storage receptacle 16 as described hereinabove. Further, vapor 28 in the liquid storage receptacle is fed back through flow circuit 40 to the inlet side of compressor 60 and thence to condenser 62 whereby the vapor is reduced to a liquid. The liquid from condenser 62 flows into inlet end 208 of separation chamber 206 of purging arrangement 202, and the relative dimensions of inlet 208 and chamber 206 provide for the velocity of the liquid refrigerant LR entering the chamber to decrease and for gas A in the liquid refrigerant to gravitate to the top of chamber 206 and to move therealong and into float and storage chamber 214 through entrance end 216 thereof. Liquid refrigerant also enters the float and storage chamber, and gas entering the latter chamber gravitates therethrough and accumulates in upper end 222 of the chamber. Liquid refrigerant with the gas thus removed flows through outlet end 210 of chamber 206 and thence through capillary expander 76 to the liquid inlet 18 line of receptacle 16.

As gas accumulates in upper end 222 of chamber 214, float 118 moves downwardly form its upward most position as defined by stop 228. When a pre-determined quantity of gas has accumulated in upper end 222 of chamber 214, float 218 engages contacts 230 to activate or close float switch 220. In the preferred embodiment, float 218 is of hollow, stainless steel construction and thus provides for bridging contacts 230 to close the switch. As mentioned above, timer 236 has a timing cycle which is initiated when selector switch 152 is moved to the position to operate the apparatus in the liquid recovery mode. If, upon the closure of float switch 220, timer 236 is in the purge mode, solenoid coil 234 is energized to open solenoid valve S4. If timer 236 is in the non-purge portion of the timer cycle, solenoid coil 234 remains de-energized until such time as the timer moves into the purge portion of the cycle. The timing cycle of timer 236 continuously repeats whereby, so long as selector switch 152 remains in the liquid recovery mode position, gas is exhausted to atmosphere from upper end 222 of chamber 214 when float switch 220 is closed and timer 236 is in the purge portion of the timer cycle. The non-purge portion of the time cycle provides a timing period during each timer cycle for gas to accumulate in upper end 222 of chamber 214, and the purge portion provides a short period for exhausting the gas. Preferably, the cycle time is 30 seconds and the purge portion of the cycle is a short time such as, for example, the last 5 seconds of each 30 seconds that the timer is activated. It will be appreciated that the exhausting of gas to atmosphere requires both the closure of float switch 220 and operation of timer 236 in the purging portion of the time cycle. It will be further appreciated that purge control circuit 204 is enabled by positioning selector switch 152 for operating the apparatus in the liquid recovery mode, and that the opening of valve S4 and thus the exhausting of gas to atmosphere is enabled thereafter by both float switch 220 and timer 236. In this respect, the valve is actuated to its open position only when the float switch is closed and the timer is in the purge portion of the time cycle.

As will be appreciated from the description thus far of the operation of purging arrangement 202, it is not necessary to pre-purge the refrigerant recovery system by manually manipulating the several valves and hose fittings as heretofore required. In this respect, any gas in the hoses or recovery apparatus will flow through liquid flow circuit 36 to the storage receptacle 16 and separate from the liquid refrigerant therein for flow through vapor feedback circuit 40 and thence to chamber 206 for separation from the liquid refrigerant, accumulation and exhausting to atmosphere as described hereinabove. Such purging in connection with initial start up of the recovery process advantageously reduces the overall recovery time.

When the liquid recovery operation is completed as indicated by observing sight glass 48, the operator manually actuates the selector switch 152 to the position thereof for the apparatus to operate in the vapor recovery mode, whereupon solenoid valve S1 closes and solenoid valves S2 and S3 open. The apparatus then operates as described hereinabove in conjunction with FIGS. 1 and 2 to flow vapor from the low pressure vapor side of refrigeration system 10 through vapor flow circuit 38, whereby the vapor is reduced to a liquid which flows through separation chamber 206 of purging arrangement 202 and thence through line 212 and solenoid valve S3 to liquid inlet line 18 of receptacle 16. More particularly in this respect, with valve S3 open the liquid flowing through chamber 202 is shunted to bypass capillary expander 76. During vapor recovery operation, switch arm 154 of selector switch 152 opens the circuit to purge control circuit 204, whereby the purging arrangement is disabled with respect to exhausting accumulated gas to atmosphere from upper end 222 of chamber 214. At the same time, however, gas in the liquid refrigerant flowing through separation chamber 206 will gravitate therefrom into chamber 214 and into upper end 222 thereof. When the temperature and thus the pressure in receptacle 16 reaches an undesirably high level, pressure responsive switch 102 automatically shifts the apparatus back to the liquid recovery mode as described hereinabove in conjunction with FIGS. 1 and 2. As will be appreciated from FIG. 4, such shifting of the apparatus control by switch 102 functions to close the circuit to purge control circuit 204 thus to actuate timer 236 and enable the exhausting of accumulated gas in upper end 222 of chamber 214 to atmosphere. If the accumulation of gas in upper end 222 of chamber 214 is sufficient at this time to close float switch 220, solenoid valve S4 will open during the purge portion of the time cycle of timer 236 to exhaust air to atmosphere for the purging time portion of the timer cycle. As described in conjunction with FIGS. 1 and 2, the shifting function resulting from the operation of pressure responsive switch 102 opens solenoid valve S1 and thus connects vapor feedback circuit 40 from receptacle 16 with the inlet side of compressor 60 and closes solenoid valves S2 and S3. Accordingly, vapor 28 in receptacle 16 is fed back to the compressor and condenser for reduction to a liquid from which gas is removed by purging arrangement 202 as described above. Again, as will be appreciated from the previous description with regard to the embodiment disclosed, the cycle of timer 236 will be activated each 30 seconds that the apparatus remains in the liquid recovery mode, enabling gas accumulated in upper end 222 of chamber 214 to be exhausted to atmosphere for 5 seconds during each 30 second cycle.

When the temperature and thus the pressure in storage receptacle 16 drops to an acceptable level, pressure responsive switch 102 shifts the control circuit back to the vapor recovery mode established by selector switch 152, whereby solenoid valve S1 closes, solenoid valves S2 and S3 open and the circuit to purge control circuit 204 is opened. The apparatus then recommences operating in the vapor recovery mode as described above. When vapor recovery is completed as described hereinabove with regard to FIGS. 1 and 2, low pressure switch 98 opens to shut down the apparatus.

While it is preferred to operate the refrigerant recovery apparatus automatically both with respect to the exhausting of accumulated gas to atmosphere from the purging arrangement and with respect to shifting the apparatus into the liquid recovery mode during a vapor recovery operation in response to the pressure in storage receptacle 16, it will be appreciated that the apparatus can be modified for these functions to be achieved manually. In this respect, for example, the purging arrangement can be provided with an indicator such as a light to visually indicate a pre-determined accumulation of gas in upper end 222 of chamber 214, and a push button valve can be provided in place of solenoid valve S4 for manual operation by the operator to exhaust gas to atmosphere until such time as the indicator light is extinguished. Further with regard to such manual operation, a temperature gage or a pressure gage could replace pressure responsive switch 102 to provide an operator with a visual indication of the temperature or pressure in storage receptacle 16. Upon observing an undesirably high pressure or temperature, the operator could manually displace selector switch 152 back to the position thereof in which the apparatus operates in the liquid recovery mode. Upon the pressure or temperature dropping to an acceptable level, the operator would then displace switch 152 back to the position for operating the apparatus in the vapor recovery mode.

Moreover, while considerable emphasis has been placed on the component parts of the purging arrangement illustrated and described herein, it will be appreciated that many modifications can be made with respect to the preferred embodiment without departing from the principals of the invention. In this respect, for example, level sensing devices other than the float arrangement disclosed can be employed for sensing the liquid level in gas accumulating chamber 214 and thus the quantity of gas accumulated therein. Alternatively, a pressure sensing arrangement could be employed in conjunction with upper end 222 of the accumulating chamber to provide for exhausting accumulated gas to atmosphere based on detecting a pre-determined pressure. Further, the exhaust valve S4 could be provided with a small valve port or orifice in place of capillary tube 226 for the purpose of controlling the flow rate of exhausted gas to atmosphere. Still further, while it is preferred to time the exhausting of accumulated gas to atmosphere as described herein, it will be appreciated that the exhausting of gas to atmosphere could be achieved under the control of the float switch or a similar device responsive to a pre-determined accumulation of gas in storage chamber 214. These and other modifications of the preferred embodiment as well as other embodiments of the invention will be obvious and suggested to those skilled in the art, whereby it is to be distinctly understood that the foregoing descriptive matter is to be interpreted merely as illustrative of the present invention and not as a limitation.

Having thus described the invention, it is claimed:

1. Apparatus for recovering refrigerant from a refrigeration system having a high pressure liquid side and a low pressure vapor side, said apparatus comprising receptacle means for receiving recovered refrigerant and having liquid inlet and vapor outlet means opening thereinto, means including vapor reducing means for flowing vapor from said low pressure side to said receptacle means as a liquid, means for flowing liquid refrigerant from said high pressure side to said receptacle means, means including control means for connecting said vapor outlet means with said vapor reducing means during said flowing of said liquid refrigerant from said high pressure side and for disconnecting said vapor outlet means from said vapor reducing means during said flowing of vapor from said low pressure side, purging means between said vapor reducing means and said liquid inlet means for removing gas from liquid refrigerant flowing to said receptacle means, and purging control means including means for enabling said purging means during said flowing of liquid refrigerant from said high pressure side and for disabling said purging means during said flowing of vapor from said low pressure side.

2. Apparatus according to claim 1, wherein means for connecting said vapor outlet means with said vapor said control means includes means responsive to a condition in said receptacle means during said flowing of said vapor from said low pressure side for disconnecting flow of vapor from said low pressure side to said reducing means and connecting said vapor outlet means with said vapor reducing means.

3. Apparatus according to claim 1, wherein said purging means includes accumulating means for accumulating gas removed from said liquid, and means including means responsive to a given accumulation of gas for releasing gas to atmosphere from said accumulating means.

4. Apparatus according to claim 1, wherein said purging means includes means for accumulating gas removed from said liquid, sensing means for sensing the amount of gas accumulated, and means including means responsive to said sensing means for releasing gas to atmosphere from said accumulating means.

5. Apparatus according to claim 1, wherein said purging means includes means for releasing gas removed from said liquid to atmosphere, and said purging control means includes means for enabling said means for releasing gas during said flowing of liquid refrigerant from said high pressure side and for disabling said means for releasing gas during said flowing of vapor from said low pressure side.

6. Apparatus for recovering refrigerant from a refrigeration system having a high pressure liquid side and a low pressure vapor side, said apparatus comprising receptacle means for receiving recovered refrigerant and having liquid inlet and vapor outlet means opening thereinto, means including vapor reducing means for flowing vapor from said low pressure side to said receptacle means as a liquid, means for flowing liquid refrigerant from said high pressure side to said receptacle means, means including control means for connecting said vapor outlet means with said vapor reducing means during said flowing of said liquid refrigerant from said high pressure side and for disconnecting said vapor outlet means from said vapor reducing means during said flowing of vapor from said low pressure side, and purging means between said vapor reducing means and said liquid inlet means for removing gas from liquid refrigerant flowing to said receptacle means, said purging means including means for releasing gas removed from said liquid to atmosphere, and means operable during said flow of liquid refrigerant for periodically enabling said means for releasing gas.

7. Apparatus according to claim 6, wherein said means for periodically enabling said means for releasing gas includes timer means having a purge mode and a non-purge mode.

8. Apparatus according to claim 7, wherein said purging means includes accumulating means for accumulating gas removed from said liquid, and said means for periodically enabling said means for releasing gas further includes means responsive to a given accumulation of gas in said accumulating means to activate said means for releasing gas when said timer means is in said purge mode.

9. Apparatus according to claim 8, wherein said means responsive to a given accumulation of gas includes switch means having activated and deactivated positions and said means for releasing gas includes valve means having open and closed positions, said switch means being in said activated position in response to said given accumulation, and said valve means being in said open position when said switch means is in said activated position and said timer means is in said purge mode.

10. Apparatus according to claim 9, wherein said timer means has a time cycle of predetermined duration, a first portion of said cycle providing said purge mode of said timer means and a second portion of said cycle providing said non-purge mode.

11. Apparatus according to claim 10, wherein said second portion of said time cycle is of longer duration than said first portion.

12. Apparatus according to claim 1, wherein said purging means includes first chamber means for receiving liquid flowing from said vapor reducing means, second chamber means above and communicating with said first chamber means for gas in said liquid to gravitate into said second chamber means, said second chamber means receiving liquid from said first chamber means and having an upper end in which said gas accumulates above liquid received therein, and means for releasing said gas from said upper end to atmosphere.

13. Apparatus according to claim 12, wherein said means for releasing gas includes normally closed valve means.

14. Apparatus according to claim 13, wherein said and purging control means includes means for controlling the opening of said valve means for releasing said gas to atmosphere.

15. Apparatus according to claim 14, wherein said purging control means includes sensing means for sensing the quantity of gas accumulated in said upper end of said second chamber means, and means including means responsive to said sensing means for enabling and disabling opening of said valve means.

16. Apparatus according to claim 15, wherein said means responsive to said sensing means includes switch means having activated and deactivated positions, said switch means in said activated position enabling opening of said valve means and in said deactivated position disabling opening of said valve means.

17. Apparatus according to claim 16, wherein said means for enabling and disabling opening of said valve means further includes timer means having a timing cycle including a purge portion and a non-purge portion, said timer means in said purge portion of said cycle enabling opening of said valve means and in said non-purge portion disabling opening of said valve means.

18. Apparatus according to claim 17, wherein said sensing means includes level sensing means for sensing the level of said liquid received in said second chamber means.

19. Apparatus according to claim 18, wherein said level sensing means includes float means.

20. Apparatus for recovering refrigerant from a refrigeration system having a high pressure liquid side and a low pressure vapor side, said apparatus comprising receptacle means for receiving recovered refrigerant and having liquid inlet and vapor outlet means opening thereunto, means including vapor reducing means for flowing vapor from said low pressure side to said receptacle means as a liquid, means for flowing liquid refrigerant from said high pressure side to said receptacle means, means including control means for connecting said vapor outlet means with said vapor reducing means during said flowing of said liquid refrigerant from said high pressure side and for disconnecting said vapor outlet means from said vapor reducing means during said flowing of vapor from said low pressure side, said control means including means responsive to a condition in said receptacle means during said flowing of vapor from said low pressure side for disconnecting flow of vapor to said reducing means from said low pressure side and for connecting said vapor outlet means with said vapor reducing means, purging means between said vapor reducing means and said liquid inlet means for removing gas from liquid refrigerant flowing to said receptacle means, said purging means including means for releasing gas removed from said liquid to atmosphere, and purge control means including means for enabling said means for releasing gas to atmosphere during said flowing of liquid refrigerant from said high pressure side and for disabling said means for releasing gas to atmosphere during said flowing of vapor from said low pressure side.

21. Apparatus according to claim 20, wherein said purge control means has enabled and disabled conditions, said purge control means being in said enabled condition during said flowing of liquid refrigerant from said high pressure side and being in said disabled condition during said flowing of vapor from said low pressure side, and said means responsive to a condition in said receptacle means including switch means for shifting said purge control means from said disabled to said enabled condition during said flowing of vapor from said low pressure side.

22. Apparatus according to claim 21, wherein said means for releasing gas to atmosphere includes normally closed electrically actuated valve means, and said purge control means includes enabling means for enabling the opening of said valve means.

23. Apparatus according to claim 22, wherein said enabling means includes timer means having activated and deactivated modes, said timer means being in said activated mode when said switch means shifts said purge control means from said disabled to said enabled condition.

24. Apparatus according to claim 23, wherein said timer means in said activated mode has a timing cycle including first and second cycle portions, said timing means in said first and second cycle portions respectively enabling and disabling opening of said valve means.

25. Apparatus according to claim 22, wherein said purging means includes means for accumulating said gas removed from liquid refrigerant and said enabling means includes means responsive to a predetermined accumulation of gas for enabling opening of said valve means.

26. Apparatus according to claim 25, wherein said switch means is first switch means and said means responsive to a predetermined accumulation of gas includes second switch means having activated and deactivated conditions respectively enabling and disabling opening of said valve means.

27. Apparatus according to claim 26, wherein said purging means includes sensing means for sensing said accumulation of gas, said second switch means being in said activated condition in response to said sensing means sensing said predetermined accumulation of gas.

28. Apparatus according to claim 27, wherein said enabling means further includes timer means having activated and deactivated modes, said timer means being in said activated mode when said first switch means shifts said purge control means from said disabled to said enabled condition.

29. Apparatus according to claim 28, wherein said timer means in said activated mode has a timing cycle including first and second cycle portions, said timing means in said first and second cycle portions respectively enabling and disabling opening of said valve means.

30. Apparatus according to claim 20, wherein said purging means includes first chamber means for receiving liquid flowing from said vapor reducing means, second chamber means above and communicating with said first chamber means for gas in said liquid to gravitate into said second chamber means, said second chamber means receiving liquid from said first chamber means and having an upper end in which said gas accumulates above liquid received therein, and said means for releasing gas being at said upper end.

31. Apparatus according to claim 30, wherein said first chamber means is a horizontally disposed first tubular chamber having spaced apart inlet and outlet passageway means connected respectively to said vapor reducing means and said liquid inlet means of said receptacle means, said second chamber means being a vertically disposed second tubular chamber having a lower end opening into said first chamber between said inlet and outlet passageway means thereof, and said means for releasing gas including outlet means in said upper end of said second chamber.

32. Apparatus according to claim 31, and capillary tube means connecting said outlet passageway means of said first chamber with said liquid inlet means of said receptacle means.

33. Apparatus according to claim 31, wherein said means for releasing gas includes means connected to said outlet means for controlling the flow rate of said gas to atmosphere.

34. Apparatus according to claim 31, wherein said lower end of said second chamber opens into said first chamber closer to said outlet passageway means than to said inlet passageway means.

35. Apparatus according to claim 31, and shunt flow line means between said first chamber and said liquid inlet means of said receptacle means for liquid from said vapor reducing means to bypass said outlet passageway means during said flowing of vapor from said low pressure side.

36. Apparatus according to claim 31, wherein said means for releasing gas includes valve means connected to said outlet means, said valve means having open and closed positions respectively enabling and blocking the flow of gas from said upper end of said second chamber to atmosphere, and said purge control means including means for enabling opening said valve means in response to a predetermined accumulation of gas in said upper end.

37. Apparatus according to claim 36, wherein said valve means is electrically activated and said means for enabling opening said valve means includes sensing means for sensing said predetermined accumulation of gas and means including switch means responsive to said sensing means for enabling activation of said valve means when said sensing means senses said predetermined accumulation.

38. Apparatus according to claim 37, wherein said sensing means includes float means in said second chamber and said switch means includes spaced apart contacts in said second chamber, said float means having a sensing position corresponding to said predetermined accumulation, and said float means including electrically conductive means for bridging said contacts in said sensing position.

39. Apparatus according to claim 36, wherein said lower end of said second chamber opens into said first chamber closer to said outlet passageway means than to said inlet passageway means.

40. Apparatus according to claim 39, wherein said valve means has upstream and downstream sides with respect to the flow of gas therethrough from said second chamber, and means on the downstream side of said valve means for controlling the flow rate of said gas to atmosphere.

41. Apparatus according to claim 40, wherein said valve means is electrically activated and said means for enabling opening said valve means includes sensing means for sensing said predetermined accumulation of gas and means including switch means responsive to said sensing means for enabling activation of said valve means when said sensing means senses said predetermined accumulation.

42. Apparatus according to claim 41, wherein said sensing means includes float means in said second chamber and said switch means responsive to said sensing means includes spaced apart contacts in said second chamber, said float means having a sensing position corresponding to said predetermined accumulation, and said float means including electrically conductive means for bridging said contacts in said sensing position.

43. Apparatus according to claim 42, wherein said means on said downstream side of said valve means includes capillary tube means.

44. Apparatus according to claim 40, and shunt flow line means between said first chamber and said liquid inlet means of said receptacle means for liquid from said vapor reducing means to bypass said outlet passageway means during said flowing of vapor from said low pressure side.

45. Apparatus according to claim 40, wherein said means for controlling the flow rate of gas to atmosphere includes capillary tube means.

46. Apparatus for recovering refrigerant from a refrigeration system having a high pressure liquid side and a low pressure vapor side, said apparatus comprising receptacle means for receiving refrigerant recovered from said system, said receptacle means including liquid passageway means and vapor passageway means opening thereunto, liquid flow circuit means having inlet end means for connection to said high pressure liquid side of said system, vapor flow circuit means having inlet end means for connection to said low pressure vapor side of said system, said liquid flow circuit means including outlet end means for connecting said liquid flow circuit means with said liquid passageway means of said receptacle means, said vapor flow circuit means including outlet end means for connecting said vapor flow circuit means with said liquid passageway means of said receptacle means, compressor means and condenser means in said vapor flow circuit means between said inlet end means and outlet end means thereof for reducing vapor to liquid, said compressor means having an inlet side, vapor flow line means between said vapor passageway means of said receptacle means and said inlet side of said compressor means, apparatus control means including means for operating said apparatus in a liquid recovery mode and a vapor recovery mode, said apparatus control means in said liquid recovery mode including means for connecting said inlet side of said compressor means in flow communication with said receptacle means through said vapor flow line means, purging means between said condenser means and said outlet end means of said vapor flow circuit means for removing gas from liquid flowing from said condenser means to said outlet end means of said vapor flow circuit means during said liquid recovery mode, said purging means including means for accumulating gas removed from said liquid, normally closed electrically activated purging valve means for releasing accumulated gas to atmosphere, and purging control circuit means for controlling opening of said valve means, said apparatus control means including means to activate said purging control circuit means in said liquid recovery mode and to deactivate said circuit in said vapor recovery mode.

47. Apparatus according to claim 46, wherein said purging control circuit means includes sensing means for sensing accumulated gas, and means including switch means responsive to said sensing means for enabling opening of said valve means when said sensing means senses a predetermined accumulation of gas.

48. Apparatus according to claim 47, wherein said means for enabling opening of said valve means further includes timer means having activated and deactivated modes respectively corresponding to activation and deactivation of said purging control circuit means.

49. Apparatus according to claim 48, wherein said timer means in said activated mode includes a time cycle having purge and non-purge time portions during which opening of said purging valve means is respectively enabled and disabled.

50. Apparatus according to claim 48, wherein said apparatus control means in said vapor recovery mode includes means for disconnecting said inlet side of said compressor means from flow communication with said receptacle means through said vapor flow line means, and means responsive to a predetermined pressure in said receptacle means during said vapor recovery mode for shifting said apparatus from said vapor recovery mode to said liquid recovery mode and for activating said purging control circuit means.

51. Apparatus according to claim 48, wherein said purging means includes first chamber means for receiving liquid flowing from said condenser means, second chamber means above and communicating with said first chamber means for gas in said liquid to gravitate into said second chamber means, said second chamber means receiving liquid from said first chamber means and having an upper end providing said means for accumulating gas removed from said liquid, said upper end including outlet means, and said purging valve means being connected to said outlet means.

52. Apparatus according to claim 51, wherein said first chamber means is a horizontally disposed first tubular chamber having spaced apart inlet and outlet passageway means connected respectively to said condenser means and said outlet end means of said vapor flow circuit means, and said second chamber means being a vertically disposed second tubular chamber having a lower end opening into said first chamber between said inlet and outlet passageway means thereof.

53. Apparatus according to claim 52, and capillary tube means connecting said outlet passageway means of said first chamber with said outlet end means of said vapor flow circuit means.

54. Apparatus according to claim 52, and capillary tube means connected to said purging valve means for controlling the flow rate of said gas to atmosphere.

55. Apparatus according to claim 52, wherein said lower end of said second chamber opens into said first chamber closer to said outlet passageway means than to said inlet passageway means.

56. Apparatus according to claim 52, and shunt flow line means between said first chamber and said outlet end means of said vapor flow circuit means for liquid from said condenser to bypass said outlet passageway means when said apparatus is in said vapor recovery mode.

57. Apparatus according to claim 46, wherein said apparatus control means in said vapor recovery mode includes means for disconnecting said inlet side of said compressor means from flow communication with said receptacle means through said vapor flow line means, and means responsive to a predetermined pressure in said receptacle means during said vapor recovery mode for shifting said apparatus from said vapor recovery mode to said liquid recovery mode and for activating said purging control circuit means.

58. Apparatus according to claim 57, further including capillary tube means connecting said outlet passageway means of said first chamber with said outlet end means of said vapor flow circuit means, and shunt flow line means between said first chamber and said outlet end means of said vapor flow circuit means for liquid from said condenser means to bypass said outlet passageway means when said apparatus is in said vapor recovery mode.

59. Apparatus according to claim 57, wherein said means for enabling opening of said valve means further includes timer means having activated and deactivate modes respectively corresponding to activation and deactivation of said purging control circuit means, said timer means in said activated mode having a time cycle including purge and non-purge portions during which opening of said purging valve means is respectively enabled and disabled.

60. Apparatus according to claim 59, wherein said purging means includes a horizontally disposed first tubular chamber having spaced apart inlet and outlet passageway means connected respectively to said condenser means and said outlet end means of said vapor flow circuit means, and a vertically disposed second tubular chamber having a lower end opening into said first chamber between said inlet and outlet passageway means thereof.

61. Apparatus according to claim 60 wherein, said lower end of said second chamber opens into said first chamber closer to said outlet passageway means than to said inlet passageway means.

62. Apparatus according to claim 61, and capillary tube means connected to said purging valve means for controlling the flow rate of said gas to atmosphere.

63. Apparatus according to claim 62, further including capillary tube means connecting said outlet passageway means of said first chamber with said outlet end means of said vapor flow circuit means, and shunt flow line means between said first chamber and said outlet end means of said vapor flow circuit means for liquid from said condenser means to bypass said outlet passageway means when said apparatus is in said vapor recovery mode.

64. A method of recovering refrigerant from a refrigeration system having a high pressure liquid side and a low pressure vapor side comprising, providing a receptacle for receiving recovered refrigerant and vapor, flowing liquid refrigerant from said high pressure side of said system to said receptacle and flowing vapor from said receptacle, reducing said vapor from said receptacle to a first liquid and flowing said first liquid to said receptacle, flowing vapor from said low pressure side of said system, reducing said vapor from said system to a second liquid and flowing said second liquid to said receptacle, collecting gas from said first liquid and from said second liquid, and periodically exhausting said collected gas to atmosphere.

65. The method according to claim 64, and detecting the quantity of said collected gas, and precluding said exhausting of said collected gas to atmosphere until a predetermined quantity is collected.

66. The method according to claim 64, and exhausting said collected gas to atmosphere at a controlled flow rate.

67. A method of recovering refrigerant from a refrigeration system having a high pressure liquid side and a low pressure vapor side comprising, providing a receptacle for receiving recovered refrigerant and vapor, flowing liquid refrigerant from said high pressure side of said system to said receptacle and flowing vapor from said receptacle, reducing said vapor from said receptacle to a first liquid and flowing said first liquid to said receptacle, flowing vapor from said low pressure side of said system, reducing said vapor from said system to a second liquid and flowing said second liquid to said receptacle, collecting gas from said first liquid and from said second liquid, exhausting said collected gas to atmosphere, stopping said flowing of vapor from said receptacle during said flowing of vapor from said low pressure side of said system, monitoring a condition in said receptacle during said flowing of vapor from said low pressure side and, in response to an undesirable condition, stopping said flowing of vapor from said low pressure side of said system, and flowing vapor from said receptacle, reducing the last named vapor to a liquid and flowing the last named liquid to said receptacle.

68. The method according to claim 67, wherein said monitored condition is pressure.

69. The method according to claim 67, and exhausting said collected gas to atmosphere during said stopping of said flowing of vapor from said low pressure side.

70. The method according to claim 67, and initiating a time cycle in response to said undesirable condition in said receptacle, and exhausting said collected gas to atmosphere during a portion of said time cycle.

71. The method according to claim 70, and repeating said time cycle until said undesirable condition is eliminated.

72. The method according to claim 70, wherein said monitored condition is pressure.

73. The method according to claim 72, and detecting the quantity of said collected gas, and precluding said exhausting of said collected gas to atmosphere until a predetermined quantity is collected.

74. The method according to claim 73, and repeating said time cycle until said undesirable condition is eliminated.

75. The method according to claim 74, and exhausting said collected gas to atmosphere at a controlled flow rate.

* * * * *

UNITED STATES PATENT AND TRADEMARK OFFICE

CERTIFICATE OF CORRECTION

PATENT NO. : 5,582,019

DATED : December 10, 1996

INVENTOR(S) : Hanna, et al.

It is certified that error appears in the above-identified patent and that said Letters Patent is hereby corrected as shown below:

Column 14, line 32, delete "means for".

Column 14, line 33, delete "connecting said vapor outlet means with said vapor".

Column 15, line 50, delete "and".

Signed and Sealed this

Twenty-ninth Day of July, 1997

Bruce Lehman

*Attest:*

BRUCE LEHMAN

*Attesting Officer*

*Commissioner of Patents and Trademarks*